US005789369A

United States Patent [19]

Gopalkrishnan et al.

[11] Patent Number: 5,789,369

[45] Date of Patent: *Aug. 4, 1998

[54] MODIFIED POLYACRYLIC ACID POLYMERS FOR ANTI-REDEPOSITION PERFORMANCE

[75] Inventors: Sridhar Gopalkrishnan, Woodhaven; Kathleen M. Guiney, Wyandotto; John V. Sherman, Allen Park, all of Mich.

[73] Assignee: BASF Corporation, Mount Olive, N.J.

[ * ] Notice: The term of this patent shall not extend beyond the expiration date of Pat. Nos. 5,734,183, 5,736,440, 5,739,099.

[21] Appl. No.: 650,927

[22] Filed: May 17, 1996

Related U.S. Application Data

[63] Continuation-in-part of Ser. No. 448,207, May 23, 1995, abandoned.

[51] Int. Cl.[6] ..... C11D 3/37; C11D 3/28

[52] U.S. Cl. ..... 510/361; 510/434; 510/476

[58] Field of Search ..... 510/361, 434, 510/476

[56] References Cited

FOREIGN PATENT DOCUMENTS 58-5398 1/1983 Japan .

*Primary Examiner*—Mukund J. Shah
*Assistant Examiner*—Bruck Kifle
*Attorney, Agent, or Firm*—Joanne P. Will

[57] ABSTRACT

A laundry detergent composition having antiredeposition properties comprising 0.01 to 20% of a hydrophilic copolymer by weight of the total surfactant in the laundry detergent composition wherein further, said hydrophilic copolymer comprises an unsaturated hydrophilic monomer and a hydrophilic oxyalkylated monomer.

9 Claims, No Drawings

MODIFIED POLYACRYLIC ACID POLYMERS FOR ANTI-REDEPOSITION PERFORMANCE

This application is a continuation in part of application Ser. No. 08/448,207, filed May 23, 1995, now abandoned.

FIELD OF THE INVENTION

The present invention relates to copolymers, and more particularly to the use of modified polyacrylic polymers in laundry detergent formulations that offer significant anti-redeposition benefits.

BACKGROUND OF THE INVENTION

Redeposition of soil on to the fabrics during laundering poses a significant problem and the art is replete with a number of additives that are incorporated in laundry detergent formulation to minimize soil redeposition.

This art is inundated with examples of additives that offer anti-redeposition advantages in laundry detergent compositions, such as the use of cellulosic polymers, polyethylene glycols of varying molecular weights, and synthetic polymers. Particularly preferred are cellulosic polymers such as carboxymethyl cellulose (CMC) and synthetic polymers such as polyvinylpyrrolidone. More-over, U.S. Pat. Nos. 4,548,744, 4,622,378, and 4,676,921 teach the utility of amine ethoxylates as anti-redeposition agents in detergent compositions. In addition, polyacrylic acid polymers of certain molecular weights offer anti-redeposition benefits when incorporated in laundry detergents. Further, Machin (WO 91/09932) discloses the use of polymers with a hydrophilic backbone and a hydrophobic sidechain as processing aids in the manufacture of granular detergents. Hardy (U.S. Pat. No. 3,719,647) discloses ethoxylated polyacrylates as whiteness maintaining agents. Hughes (U.S. Pat. No. 5,130,369) discloses a process for preparing functionalized polycarboxylates. Nippon (Kokai 58-5398) discloses the use of modified polycarboxylates as builders in granular detergents at levels of greater than 25 parts polymer/100 parts surfactant.

While the known anti-redeposition additives have soil suspension properties, they do not have adequate performance when it comes to particulate soil suspension and anti-redeposition, in particular, clay soil. Cellulosic polymers such as hydroxypropyl methylcellulose offer good anti-redeposition advantages for oil type soil, but also do not offer significant anti-redeposition benefits for particulate soil removal, specifically clay soil.

OBJECTS OF THE INVENTION

It is therefore an object of this invention to provide polymers with improved anti-redeposition properties for incorporation into laundry detergents for the purpose of minimizing redeposition of particulate soils, such as clay soil, during the laundering process.

Another object of the invention is to provide a method of preventing redeposition of particulate soils, such as clay soil, during the laundering process.

SUMMARY OF THE INVENTION

These and other objects of the invention are achieved by a laundry detergent composition comprising 0.01 to 20% of a hydrophilic copolymer by weight of the total surfactant in the laundry detergent composition. Said hydrophilic copolymer comprises an unsaturated hydrophilic monomer and a hydrophilic oxyalkylated monomer, which provides superior anti-redeposition benefits compared to conventional polycarboxylate polymers used in laundry detergents.

Preferably, the hydrophilic copolymer mentioned above has the following structure:

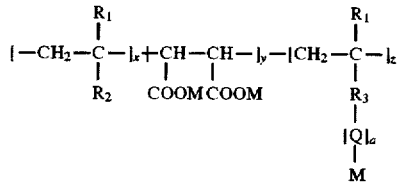

Formula I where x, y, z and a are integers; R3, Q, and M comprise the hydrophilic oxyalkylated monomer sidechain and Q is oxyethylene or a mixture of oxyethylene with C3–C4 oxyalkylene with the proviso that said sidechain has a solubility of at least 500 g/L in water; M is an alkali metal such as sodium or hydrogen. (x+y):z is from about 5:1 to 1000:1, and y is zero or equal to x, and further x cannot be zero;

$R_1$ = H or $CH_3$;

$R_2$ = COOM, $OCH_3$, $SO_3M$, O−CO−$CH_3$, CO−$NH_2$;

$R_3$ = $CH_2$−O−, $CH_2$−N−, −O−, $CH_2$−O−$CH_2$−CH(O)−O−, CO−NH−;

DEFINITIONS AND USAGES OF TERMS

The terms "oxyalkylene" and "alkylene oxide" are synonymous, and can be used interchangeably.

DETAILED DESCRIPTION OF THE INVENTION

The laundry detergent composition of the present invention comprises 0.01 to 20% of a hydrophilic copolymer by weight of the total surfactant in the laundry detergent composition, preferably 1–15%, and more preferably 5–10%. Said hydrophilic copolymer comprises an unsaturated hydrophilic monomer and an oxyalkylated monomer, which provides superior anti-redeposition benefits compared to polycarboxylate polymers used in laundry detergents.

Preferably, the hydrophilic copolymer mentioned above has the following structure:

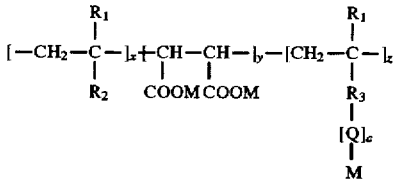

Formula I where x, y, z, and a are integers; R3, Q, and M comprise the hydrophilic oxyalkylated monomer sidechain and Q is oxyethylene or a mixture of oxyethylene with C3 or C4 oxyalkylene with the proviso that said sidechain has a solubility of at least 500 g/L in water. Further, the arrangement of the oxyalkylene moieties in said sidechain can be either in a block sequence or randomly distributed in the sidechain. Thus, given this solubility requirement, the oxyethylene monomer will be the predominant monomer (Q) in the hydrophilic copolymer sidechain. M is an alkali metal such as sodium or hydrogen. (x+y):z is from about 5:1 to 1000:1, preferably 50:1 to 800:1, more preferably about 100:1 to 500:1. Further y is zero or equal to x, and x cannot be zero;

$R_1$ = H or $CH_3$;

$R_2$ = COOM, $OCH_3$, $SO_3M$, O−CO−$CH_3$, CO−$NH_2$;

$R_3$ = $CH_2$−O−, $CH_2$−N−, −O−, $CH_2$−O−$CH_2$−CH(O)−O−, CO−NH−;

The total molecular weight of the copolymer should be within the range of about 1000 to 100,000, as determined by gel permeation chromatography. More preferably, the molecular weight falls within the range of about 1,000 to 30,000; most preferably within the range of about 1,000 to 20,000; (weight average molecular weight—WAMW; unless otherwise specified, molecular weights herein are given in terms of WAMW).

The hydrophilic copolymer of the present invention is prepared by copolymerizing two monomers, an unsaturated hydrophilic monomer copolymerized with an hydrophilic oxyalkylated monomer.

Examples of unsaturated hydrophilic monomers useful in the present invention include acrylic acid, maleic acid, maleic anhydride, methacrylic acid, methacrylate esters and substituted methacrylate esters, vinyl acetate, vinyl alcohol, methylvinyl ether, crotonic acid, itaconic acid, vinyl acetic acid, and vinylsulphonate. Preferably, the unsaturated hydrophilic monomer component of the hydrophilic copolymer in formula I is acrylic acid.

Examples of the hydrophilic oxyalkylated monomer include compounds that have a polymerizable olefinic moiety with at least one acidic hydrogen and are capable of undergoing addition reaction with alkylene oxide. It is also possible to include monomers with at least one acidic hydrogen that are polymerized first, and then subsequently oxyalkylated to yield the desired product. For example, allyl alcohol is especially preferred since it represents a monofunctional initiator with a polymerizable olefinic moiety having an acidic hydrogen on the oxygen, and is capable of adding to alkylene oxide. Other examples of the hydrophilic oxyalkylated monomer of the copolymer include reaction products of either acrylic acid, methacrylic acid, maleic acid, or 3-allyloxy-1,2-propanediol with alkylene oxide. Preparation of oxyalkylated monomers is disclosed in U.S. Pat. No. 5,162,475 and U.S. Pat. No. 4,622,378 both incorporated by reference herein.

Especially preferred is the hydrophilic oxyalkylated monomer which is a propylene Is oxide and ethylene oxide adduct of allyl alcohol. This monomer has a molecular weight of about 3800. In this oxyalkylated monomer, $R_1$=H, $R_2$=COOM where M is sodium, $R_3$=$CH_2$—O, and y=O. In this embodiment, Q is a mixture of oxyethylene and oxypropylene monomers and further, the hydrophilic oxyalkylated monomer has a solubility of greater than 500 grams/liter.

The molecular weight of the hydrophilic oxyalkylated monomer according to the various embodiments of the invention should be preferably within the range of about 600 to 30,000, more preferably about 700 to 15,000, and most preferably about 700 to 5000. The hydrophilic oxyalkyated monomer preferably has a solubility of about 500 grams/liter, more preferably about 700 grams/liter in water.

The said hydrophilic oxyalkylated monomer sidechain, comprised of $R_3$, Q, and M, is composed predominantly of oxyethylene groups, and may optionally contain minor amounts of propyleneoxy groups or butyleneoxy groups. Further, the relative amounts of oxyethylene and oxypropylene or oxybutylene in said sidechain are such that, the oxyalkylated monomer has a solubility of about 500 grams/liter or greater, in water.

The laundry detergent composition of the present invention also contains detergent active matter selected from the group of anionic, nonionic, cationic, amphoteric and zwitterionic surfactants known to the skilled artisan. Examples of these surfactants may be found in McCutcheon, *Detergents and Emulsifiers* (1993), incorporated herein by reference. Examples of nonionic surfactants will include commonly utilized nonionic surfactants which are either linear or branched and have an HLB of from about 6 to 18, preferably from about 10 to 14. Examples of such nonionic detergents are alkylphenol oxyalkylates (preferably oxyethylates) and alcohol oxyethylates. Examples of the alkylphenol oxyalkylates include $C_6$–$C_{18}$ alkylphenols, preferably $C_7$ to $C_8$, with about 1–15 moles of ethylene oxide or propylene oxide or mixtures of both. Examples of alcohol oxyalkylates include $C_6$–$C_{18}$ alcohols with about 1–15 moles of ethylene oxide or propylene oxide or mixtures of both. Some of these types of nonionic surfactants are available from BASF Corp. under the trademark PLURAFAC. Other types of nonionic surfactants are available from Shell under the trademark NEODOL. In particular, a $C_{12}$–$C_{15}$ alcohol with an average of 7 moles of ethylene oxide under the trademark NEODOL® 25-7 is especially useful in preparing the laundry detergent compositions useful in the invention. Other examples of nonionic surfactants include products made by condensation of ethylene oxide and propylene oxide with ethylene diamine (BASF, TETRONIC® and TETRONIC® R). Also included are condensation products of ethylene oxide and propylene oxide with ethylene glycol and propylene glycol (BASF, PLURONIC® and PLURONIC® R). Other nonionic surface active agents also include alkylpolyglycosides, long chain aliphatic tertiary amine oxides and phosphine oxides.

Typical anionic surfactants used in the detergency art include the synthetically derived water-soluble alkali metal salts of organic sulphates and sulphonates having about 6 to 22 carbon atoms, preferably 12 to 15 carbon atoms. The commonly used anionic surfactants are sodium alkylbenzene sulphonates, sodium alkylsulphates and sodium alkylether sulphates. Other examples include N-alkylglucosamides, reaction products of fatty acids with isethionic acid neutralized with sodium hydroxide, sulphate esters of higher alcohols derived from tallow or coconut oil, and alphamethylestersulfonates.

Examples of ampholytic detergents include straight or branched aliphatic derivatives of heterocyclic secondary or tertiary amines. The aliphatic portion of the molecule typically contains about 8 to 20 carbon atoms, preferably 12 to 15 carbon atoms. Zwitterionic detergents include derivatives of straight or branched aliphatic quaternary ammonium, phosphonium or sulfonium compounds.

The laundry formulation of the present invention will contain about 5–70% of surfactants, more preferably 15%–40% and most preferably 25%–35%.

The copolymer of the invention may be prepared by the skilled artisan according to the process below, in which the alkylene oxide adduct of allyl alcohol is copolymerized with acrylic acid by way of a non-limiting example.

EXAMPLES

I. A. Preparation of Oxyalkylated Monomer (Alkylene Oxide Adduct of Allyl Alcohol)

To a 2 gallon stainless steel autoclave equipped with steam heat, vacuum and nitrogen pressure capability and agitation, a homogenous mixture of 396.2 grams of allyl alcohol and 44.1 grams of potassium t-butoxide was charged. The vessel was sealed, purged with nitrogen and pressurized to 90 psig with nitrogen. The pressure was then relieved to 2 psig and the temperature of the vessel was adjusted to 80° C. The first 125 grams of propylene oxide was added over a 1 hour period. The temperature was maintained between 70°–85° C. and the pressure was maintained at <90 psig. The next 200 grams of propylene oxide was added over a 1 hour period and at 75°–85° C. and <90 psig pressure. The next 400 grams of propylene oxide was added over a 1 hour period at 100°–110° C. and <90 psig pressure. The remaining 4551.2 grams of propylene oxide was charged at 500 grams per hour and at 120°–130° C. and <90 psig pressure. After all of the propylene oxide was added, the mixture was reacted at 125° C. for 2 hours and the vessel was vented to 0 psig. The material was stripped at <10 mm Hg and 125° C. for 1 hour then cooled to 50° C. and discharged into an intermediate holding tank for analysis.

To a 5 gallon stainless autoclave equipped with steam heat, vacuum and nitrogen pressure capability and agitation, 2696.8 grams of the allyl alcohol propylene oxide intermediate was charged. The vessel was sealed and pressurized to 90 psig with nitrogen and vented to 2 psig. This was repeated two more times. The temperature was adjusted to 145° C. and the pressure was readjusted to 34 psig with nitrogen. To the vessel, 10788.9 grams of ethylene oxide was charged at 1400 grams per hour. The temperature was maintained at 140°–150° C. and the pressure was maintained at <90 psig. If the pressure rose above 85 psig, the ethylene oxide addition was slowed. If this failed to lower the pressure, the addition was halted and allowed to react at 145° C. for 30 minutes. The vessel was slowly vented to 0 psig and repadded to 34 psig with nitrogen. The addition was continued at 140°–150° C. and <90 psig pressure. After all of the ethylene oxide was added, the material was held at 145° C. for 1 hour. It was then cooled to 90° C. and 14.3 grams of 85% phosphoric acid was added. The material was mixed for 30 minutes and then vacuum stripped at 100° C. for 1 hour. The batch was cooled to 70° C. and discharged into a holding tank. The product was found to have a number average molecular weight of 4091 by phthalic anhydride esterification in pyridine.

I.B. Polymerization of Hydrophilic Oxyalkylated Monomer with Hydrophilic Monomer (Acrylic Acid)

To a 2 liter, four necked flask equipped with a mechanical stirrer, reflux condenser, thermometer, and outlet for feed lines, were added 301 grams of distilled water and 2.6 grams of 70% phosphorous acid. This solution was heated to 95 degrees centigrade at which time a monomer blend of 555.4 grams of glacial acrylic acid and 61.7 grams of an allyl alcohol initiated propoxylate ethoxylate (molecular weight @ 3500), a redox initiator system consisting of 132 grams of 38% sodium bisulfite solution and 155.4 grams of a 10.9% sodium persulfate solution, were fed into the flask linearly and separately while maintaining the temperature at 95±3 degrees centigrade. The sodium bisulfite solution and monomer blend feeds were added over 4 hours while the sodium persulfate solution was added over 4.25 hours. The three feeds were added via teflon ⅛ inch tubing lines connected to rotating piston pumps. Appropriately sized glass reservoirs attached to the pumps hold the monomer blend and initiator feeds on balances accurate to 0.1 gram to precisely maintain feed rates. When the additions were complete, the system was cooled to 80 degrees centigrade. At 80 degrees centigrade, 25.3 grams of a 2.4% 2,2'-Azobis (N,N'-dimethylene-isobutyramidine) dihydrochloride solution was added to the system over 0.5 hours as a postpolymerizer. When addition was complete, the system was reacted for 2 hours at 80 degrees centigrade. After reaction, the system was cooled to 60 degrees centigrade and the solution pH was adjusted to about 7 with the addition of 658 grams of 50% sodium hydroxide solution. The resultant neutral polymer solution had an approximate solids content of 40%.

II. Anti-Redeposition Properties

The following examples described in Charts 1 and 2 will serve to demonstrate the efficacy of the copolymer according to various embodiments of the invention. The example should not be construed as limiting the scope of the invention.

All tests were performed using a six-pot Terg-O-Tometer obtained from US Testing Corp. of New Jersey. A 10 minute wash and a 5 minute rinse cycle was employed. The wash and rinse temperature was set at 95° F. Nine clay cotton swatches obtained from Scientific Services of New Jersey were used in each pot to provide a significant clay soil load in the wash cycle. In addition, the wash liquor in each pot was spiked with an additional 300 mg of Bandy Black Clay soil. The anti-redeposition performance of the copolymers of this invention were measured over three wash and rinse cycles, using six clean cotton swatches in the first cycle. These swatches are carried over through three wash and rinse cycles. After each wash and rinse cycle, the clay soiled cotton swatches used to provide the clay soil load to the wash liquor were discarded and a fresh set of nine clay swatches were added at the beginning of each wash cycle. At the end of the third rinse cycle, the cotton swatches were dried in a Whirlpool dryer for 90 minutes. The reflectance of the dried swatches were then measured using a Hunter calorimeter. The difference in the reflectance values between the initial clean cotton swatch and the reflectance value of the cotton swatch after three wash and rinse cycles are reported in Charts 1 and 2.

The nonionic surfactant used in the formulation is NEODOL® 25-7, a product of Shell. The linear alkylbenzene sulfonic acid, sodium salt (LAS) was obtained from Vista under the name Vista C-560 slurry. The zeolite was "ZEOLITE A", also known as VALFOR® 100, available from the PQ Corp. of Valley Forge, Pa. The sodium carbonate was obtained from the FMC Corporation under the name "FMC Grade 100". The sodium silicate used was sodium silicate pentahydrate obtained from Mayo products. SOKALAN® PA30C1 (Polyacrylic acid, sodium salt) is a product of BASF Corp. SOKALAN® HP 22 (nonionic graft copolymer) is a product of BASF Corp.

The following nonlimiting examples illustrate the present invention:

Polymer A is a copolymer of acrylic acid with an oxyalkylated allyl alcohol, within the scope of the invention. The ratio of acrylic acid to the oxyalkylated allyl alcohol is 85:15 by weight, while the molar ratio was about 123:1. The oxyalkylated monomer (Q) component has a molecular weight of about 1500, and Q is a block of oxypropylene followed by a block of oxyethylene—wherein further, the solubility of the hydrophilic oxyalkylated monomer sidechain is at least 500 g/l in water; $R_1$=H, $R_2$=COONa, $R_3$=$CH_2$—O, and y =0.

Polymer B is a copolymer of acrylic acid with an oxyethylated allyl alcohol, within the scope of the invention. The ratio of acrylic acid to the oxyethylated allyl alcohol was 70:30 by weight, while the molar ratio was about 131:1. The oxyethylated monomer component had a molecular weight of about 4100, Q=oxyethylene and the solubility of the hydrophilic monomer sidechain is at least 500 g/L in water; $R_1$=H, $R_2$=COONa, $R_3$=$CH_2$—O, and y=0.

Polymer C is a copolymer of acrylic acid with an oxyalkylated allyl alcohol, within the scope of the invention. The ratio of acrylic acid to the oxyalkylated allyl alcohol was 90:10 by weight, while the molar ratio was about 474:1. The oxyalkylated monomer component had a molecular weight of about 3800, and Q is a block of oxypropylene followed by a block of oxyethylene—wherein further, the solubility of the hydrophilic oxyalkylated monomer sidechain is at least 500 g/L in water; $R_1$=H, $R_2$=COONa, $R_3$=$CH_2$—O, and y=0.

Polymer D is a copolymer of acrylic acid with an oxyethylated allyl alcohol, within the scope of the invention. The ratio of acrylic acid to the oxyethylated allyl alcohol was 92.3:7.7 by weight, while the molar ratio was about 116:1. The oxyethylated monomer component had a molecular weight of 700, Q=oxyethylene and the solubility of the hydrophilic sidechain is at least 500 g/l in water; $R_1$=H, $R_2$=COONa, $R_3$=$CH_2$—O, and y=0.

Charts 1 and 2 show the anti-redeposition performance of commercial polymers such as Sokalan PA30C1 and Sokalan HP22 polymers as well as polymers of the invention, in anionic and nonionic based detergent formulas. Both of these charts demonstrate the significant anti-redeposition benefits provided by the polymers of this invention when compared to conventional anti-redeposition polymers used in detergent formulations.

While the invention has been described in each of its various embodiments, it is to be expected that certain modifications thereto may occur to those skilled in the art without departing from the true spirit and scope of the invention as set forth in the specification and the accompanying claims.

What is claimed is:

1. A laundry detergent composition comprising 0.01 to 20% of a hydrophilic copolymer by weight of the total surfactant in the laundry detergent composition wherein further, said hydrophilic copolymer comprises an unsaturated hydrophilic monomer and a hydrophilic oxyalkylated monomer having the following structure:

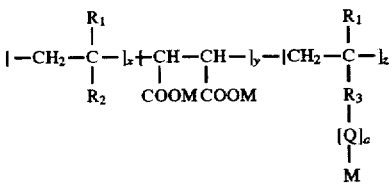

Formula I where R3, Q, and M comprise the hydrophilic oxyalkylated monomer sidechain; and M is an alkali metal or hydrogen; Q is an oxyethylene or a mixture of oxyethylene with C3 or C4 oxyalkylene; a is an integer such that said sidechain has a solubility of at least 500 g/l in water; (x+y):z is from about 5:1 to 1000:1, and y is from zero up to the value of x, and further x cannot be zero;

$R_1$ = H or $CH_3$;

$R_2$ = COOM, $OCH_3$, $SO_3M$, O—CO—$CH_3$, CO—$NH_2$;

$R_3$ = $CH_2$—O—, $CH_2$—N—, —O—,

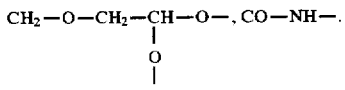

2. The laundry detergent composition of claim 1, wherein said copolymer has a molecular weight within the range of about 1000 to 100,000.

3. The laundry detergent composition of claim 2, wherein said copolymer has a molecular weight within the range of about 1000 to 20,000.

4. The laundry detergent composition of claim 1, wherein $R_1$=H, $R_2$=COOM, wherein M is sodium, $R_3$=$CH_2$—O, y=0, Q is oxyethylene or a mixture of oxyethylene with C3 or C4 oxyalkylene with the proviso that said sidechain has a solubility of at least 500 g/l in water.

5. A composition according to claim 4, wherein said hydrophilic oxyalkylated monomer has a molecular weight of 700–5000.

6. A method of preventing soil redeposition, comprising adding 0.01 to 20% of a hydrophilic copolymer by weight of the total surfactant in the laundry detergent composition wherein further, said hydrophilic copolymer comprises an unsaturated hydrophilic monomer and a hydrophilic oxyalkylated monomer having the following structure:

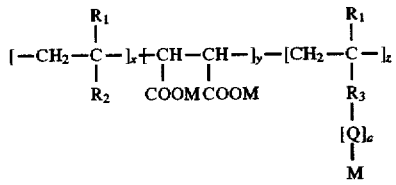

Formula I where x, y, z and a are integers; R3, Q, and M comprise the hydrophilic oxyalkylated monomer sidechain and Q is oxyethylene or a mixture of oxyethylene with C3 or C4 oxyalkylene with the proviso that said sidechain has a solubility of at least 500 g/l in water; M is an alkali metal such as sodium or hydrogen, (x+y):z is from about 5:1 to 1000:1, and y is from zero up to the value of x, and further x cannot be zero;

$R_1$ = H or $CH_3$;

$R_2$ = COOM, $OCH_3$, $SO_3M$, O—CO—$CH_3$, CO—$NH_2$;

$R_3$ = $CH_2$—O—, $CH_2$—N—, —O—,

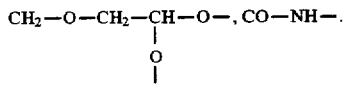

7. The method of claim 6, wherein said copolymer has a molecular weight within the range of about 1000 to 100,000.

8. The method of claim 7, wherein said copolymer has a molecular weight within the range of about 1000 to 20,000.

9. The method of claim 6, wherein $R_1$=H, $R_2$=COOM, wherein M is sodium, $R_3$=$CH_2$—O, y=0, Q is oxyethylene or a mixture of oxyethylene with C3 or C4 oxyalkylene with the proviso that said sidechain has a solubility of at least 500 g/l in water.

* * * * *